United States Patent [19]

Tsuji

[11] Patent Number: 4,485,850

[45] Date of Patent: Dec. 4, 1984

[54] AUXILIARY DEVICE FOR WEFT INSERTION ON AN AIR JET LOOM

[75] Inventor: Kanji Tsuji, Ishikawa, Japan

[73] Assignee: Tsudakoma Kogyo Kabushiki Kaisha, Japan

[21] Appl. No.: 356,638

[22] Filed: Mar. 10, 1982

[30] Foreign Application Priority Data

Mar. 11, 1981 [JP] Japan ..... 56-034666[U]

[51] Int. Cl.[3] ..... D03D 47/30

[52] U.S. Cl. ..... 139/435

[58] Field of Search ..... 139/435, 192; 226/97

[56] References Cited

U.S. PATENT DOCUMENTS 3,557,845 1/1971 Svaty et al. ..... 139/435
3,911,968 10/1975 Zollinger ..... 139/435
4,357,963 11/1982 Scheffel ..... 139/435
4,384,597 5/1983 Tsuji ..... 139/435
4,438,790 3/1984 Steiner ..... 139/435

FOREIGN PATENT DOCUMENTS 2072719 10/1981 United Kingdom ..... 139/435

*Primary Examiner*—Henry S. Jaudon
*Attorney, Agent, or Firm*—Lerner, David, Littenberg, Krumholz & Mentlik

[57] ABSTRACT

On a fluid jet loom on which a reed is formed by an array of air guide elements having front cutouts for defining an air guide channel, an auxiliary reed is arranged movable towards and away from the reed in order to temporarily cover the front opening of the air guide channel at least during weft insertion, thereby significantly reducing air leakage from the air guide channel for low power consumption and blocking plunge of weft out of the air guide channel for stable weft insertion.

3 Claims, 2 Drawing Figures

AUXILIARY DEVICE FOR WEFT INSERTION ON AN AIR JET LOOM

The present invention relates to auxiliary device for weft insertion on an air jet loom, and more particularly relates to a device for assisting control of weft insertion by a reed on an air jet loom on which the reed is formed by a number of air guide elements arranged side by side in the direction of weft insertion in order to provide an air guide channel for defining a path of travel for the weft.

On an air jet loom of the above-described type, each weft entrained on an air jet ejected by a main nozzle travels through the air guide channel formed by the juxtaposed air guide elements for weft insertion. Each air guide element is provided with a cutout opening forwards. When the air jet ejected by the main nozzle has no sufficient weft transportation energy for stable and successful weft insertion, auxiliary nozzles are arranged in front of the reed at prescribed intervals in the direction of weft insertion in order to sequentially apply ejection of additional air jet to the weft under transportation.

Since the cutout of each yarn guide element opens forwards, the air jet traveling through the air guide channel tends to leak forwards. In order to compensate such inevitable air leakage from the air guide channel, the amount of the air jet has to be increased whilst resulting in increased power consumption. In addition, too significant air jet would cause the weft to plunge out of the air guide channel, i.e. a normal path of travel for the weft, whilst disenabling stable weft insertion.

In order to avoid such inconveniencies, it is required to reduce the air leakage from the air channel. In order to suffice such a requirement, it is thinkable to minimize the front opening of the cutout of the air guide element. Presence of such a minimized front opening, however, would disenable normal beating motion by the air guide element and cause its jaw to hook the warps forming the shed. For these reasons, it is quite infeasible to minimize the front openings of the cutouts of the air guide elements.

SUMMARY OF THE INVENTION

It is the object of the present invention to reduce the air leakage from the air guide channel for stabler weft insertion without any change in design of the air guide elements defining the air guide channel.

In accordance with the basic aspect of the present invention, the front opening of each air guide element is temporarily covered with a separate member at least during weft insertion in order to control the direction of air jet in the air guide channel and reduce air leakage from the air guide channel.

DESCRIPTION OF THE PREFERRED EMBODIMENT

Figure 1:
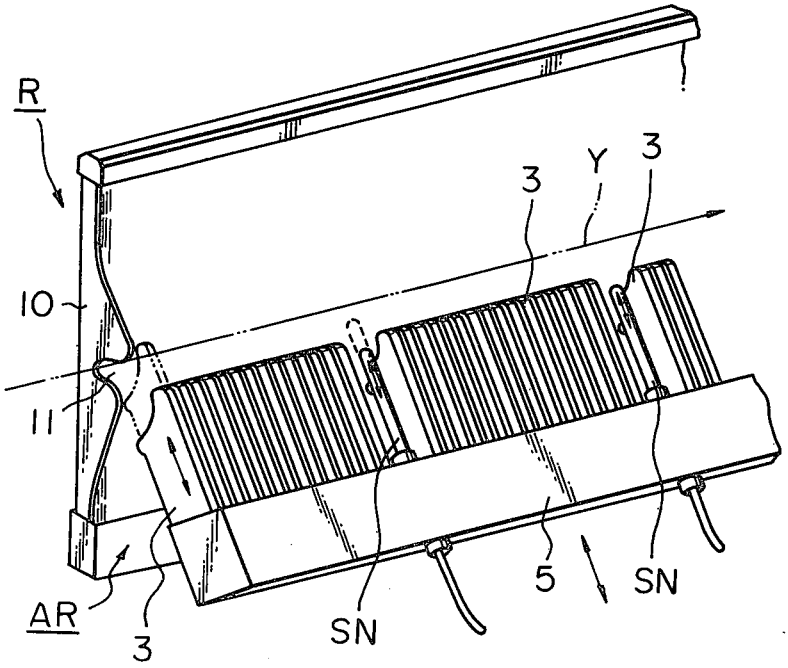
FIG. 1 is a perspective view of one embodiment of the auxiliary device in accordance with the present invention and its related parts.

One embodiment of the auxiliary device in accordance with the present invention is shown in FIG. 1, in which each air guide element 10 of a reed R is provided with a cutout 11 opening forwards and a straight air guide channel is formed by the cutouts 11 of a number of air guide elements 10 arranged side by side in the direction of weft insertion. Each air guide element 10 is accompanied on the front side with a comb tooth-like auxiliary air guide element 3 whose point is directed towards the cutout of the associated air guide element 10. As a consequence, the reed R formed by an array of the air guide elements 10 is accompanied with an auxiliary reed AR formed by an array of the auxiliary air guide elements 3 arranged on the front side. During the beating motion of the loom, the auxiliary air guide elements 3 rest at a stand-by position shown with solid lines in the drawing in order to allow free beating motion of the reed R, whereas the advance towards an operating position shown with chain lines in the drawing during the next weft insertion in order to cover the front openings of the cut-outs 11 of the air guide elements 10. In other words, the auxiliary reed AR is arranged reciprocal between the stand-by and operating position following a prescribed programme. Since the direction of the air jet in the air guide channel during weft insertion is controlled by the air guide elements 10 and the auxiliary air guide elements 3 registered at the operating position, leakage of the air jet from the air guide channel can well be blocked.

Figure 2:
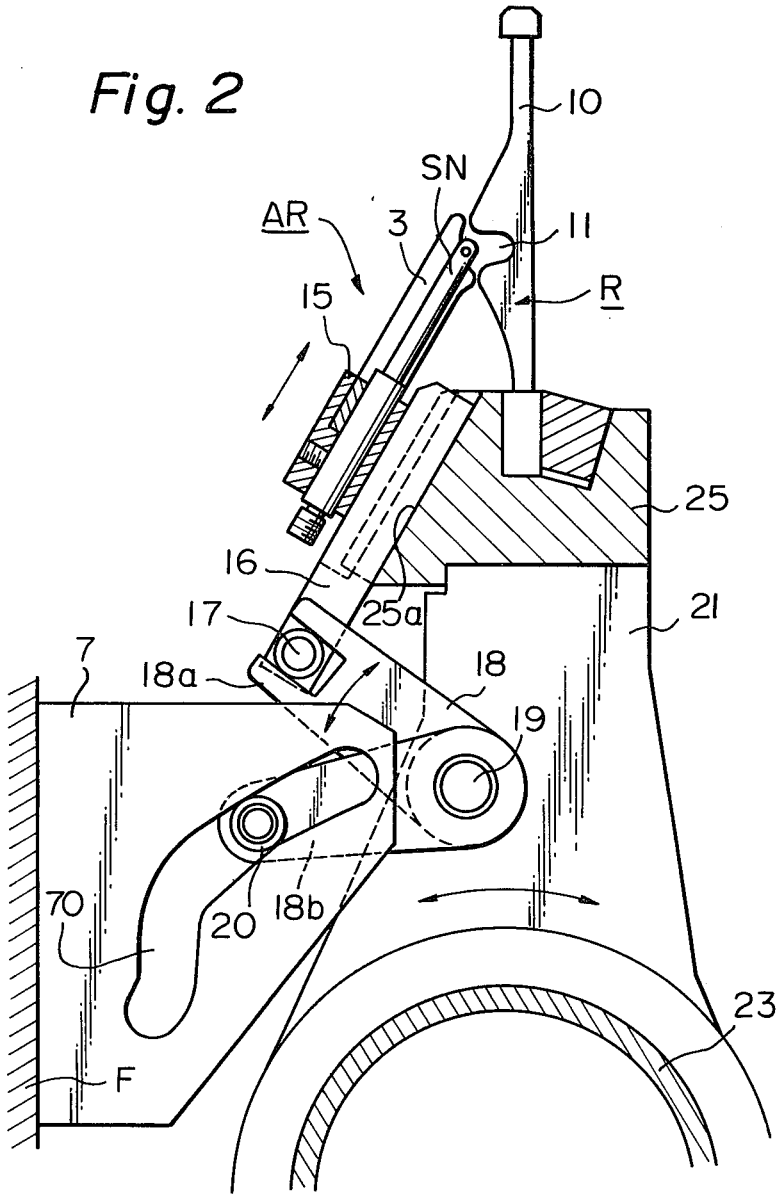
FIG. 2 is a side view, partly in section, of the auxiliary device shown in FIG. 1.

One embodiment of the drive mechanism for causing the above-described reciprocal motion of the auxiliary air guide element 3 is shown in FIG. 2, in which the array of the auxiliary air guide elements 3 is supported at its lower end by a slide bar 15 extending in the direction of weft insertion. A number of inclined grooves **25*a* are formed in the front face of a slay 25 holding the array of the air guide elements 10 and the slide bar 15 is fixed atop a plurality of guide bars 16 slidably received in the inclined grooves 25*a* which extends normal to the direction of weft insertion. The lower ends of the guide bars 16 are coupled to each other by means of a lateral pin 17**.

A bifurcate lever 18 is pivoted at its apex to a lateral pin 19 fixed to the side face of slay sword 21 which coupled the slay 25 to a rocking shaft 23 of the loom. The distal end of the upper branch **18*a* of the bifurcate lever 18 a cutout in which an appropriate longitudinal section of the lateral pin 17 is received. The distal end of the lower branch 18*b* of the bifurcate lever 18 rotatably carries a roller 20 which is received in an cam slot 70 formed in a plate 7** fixed to the framework F of the loom.

As the slay sword 21 with the slay 25 swings about the axis of the rocking shaft 23 for beating motion, the bifurcate lever 18 follows this swing motion and the roller 20 held by its lower branch **18*b* travels in the cam slot 70. Then, the bifurcate lever 18 as a whole swings about the lateral pin 19 due to the curvature of the cam slot 70 in engagement with the roller 20. This swing motion of the bifurcate lever 18 causes corresponding reciprocal sliding motion of the guide bar 16 in the inclined groove 25*a* of the slay 25. This connects to concurrent reciprocal motion of the slide bar 15 and the array of the auxiliary air guide elements 3 held by the slide bar 15**.

More specifically, when the slay sword 21 swings counterclockwise in the drawing about the axis of the rocking shaft 23 for beating motion, the bifurcate lever 18 moves forwards, i.e. leftwards in the drawing. Then, due to the forwardly descending curvature of the cam slot 70 engaging the roller 20, the bifurcate lever 18 is forced to turn counterclockwise about the lateral pin 19 and its upper branch 18*a* pulls the guide bar 16 downwards via the lateral pin 17 so that the array of the auxiliary air guide elements 3, i.e. the auxiliary reed AR, should assume the stand-by position outside the ambit of the beating motion.

After the beating motion is over and the next weft insertion is about to start, the slay sword 21 swings clockwise in the drawing about the axis of the rocking shaft 23 for weft insertion and the bifurcate lever 18 moves rearwards, i.e. rightwards in the drawings. Then due to the rearwardly ascending curvature of the cam slot 70 engaging the roller 20, the bifurcate lever 18 is forced to turn clockwise about the lateral pin 19 and its upper branch 18*a* pushes the guide bar 16 upwards via the lateral pin 17 so that the array of the auxiliary air guide elements 3, i.e. the auxiliary reed AR, should move towards the operating position whereat the points of the auxiliary air guide elements 3 cover the front opening of the cutouts 11 of the air guide elements 10.

Registration of the array of the auxiliary air guide elements 3 is timed to initial ejection of the air jet by the main nozzle.

When auxiliary nozzles are used for ejection of additional air jet, they are conventionally fixed to the slay 25 at positions not to hinder smooth beating motion. It is lately proposed, however, to temporarily locate the auxiliary nozzles at positions as close as possible to the air guide channel formed by the array of the air guide elements 10.

In such circumstances, auxiliary nozzles SN may be either directly or indirectly coupled to the slide bar 15 in accordance with the present invention. Conversely, the array of the auxiliary air guide elements 3 may be coupled to a drive mechanism which causes reciprocal motion of the auxiliary nozzles SN for the above-described location.

In accordance with the present invention, the front openings of the cutouts of the air guide element 10 are temporarily covered by the auxiliary air guide elements 3, thereby significantly reducing air leakage from the air guide channel for reduced power consumption. This greatly contributes to saving of energy. In addition, undesirable plunge of weft out of the air guide channel can be well blocked for stabler weft insertion.

I claim:

1. Auxiliary device for weft insertion on an air jet loom comprising a reed formed by an array of air guide elements which are arranged in the direction of weft insertion and provided with generally U-shaped cutouts having front openings provided between upper and lower portions of said air guide elements for defining an air guide channel, an auxiliary reed formed by an array of auxiliary air guide elements which are arranged in said direction of weft insertion and located on the front side of said reed, said auxiliary air guide elements having forward portions being directed towards said air guide channel, and means for reciprocating said auxiliary reed normal to said reed between an operating position closer to said air guide channel and a stand-by position so that said forward portions of said auxiliary air guide elements are brought adjacent said upper and lower portions of said air guide elements for temporarily covering said front opening of said cutouts in said air guide elements at least during said weft insertion.

2. Auxiliary device as claimed in claim 1 in which said reciprocating means is operationally coupled to at least one auxiliary nozzle.

3. Auxiliary device as claimed in claim 1 or 2 in which said reciprocating means includes a slide bar coupled to feet of said auxiliary air guide elements, a cam operated lever swingable about a given pivot on a slay sword of said loom, means for converting swing motion of said cam operated lever into reciprocal motion of said slide bar normal to said air guide channel.

* * * * *